US011969006B2

(12) United States Patent
Reevell

(10) Patent No.: US 11,969,006 B2
(45) Date of Patent: Apr. 30, 2024

(54) AEROSOL-GENERATING ARTICLE HAVING AEROSOL-GENERATING SUBSTRATE WITH DUAL PLUGS

(71) Applicant: Philip Morris Products S.A., Neuchatel (CH)

(72) Inventor: Tony Reevell, London (GB)

(73) Assignee: Philip Morris Products S.A., Neuchatel (CH)

( * ) Notice: Subject to any disclaimer, the term of this patent is extended or adjusted under 35 U.S.C. 154(b) by 705 days.

(21) Appl. No.: 16/766,566

(22) PCT Filed: Dec. 6, 2018

(86) PCT No.: PCT/EP2018/083842
§ 371 (c)(1),
(2) Date: May 22, 2020

(87) PCT Pub. No.: WO2019/110747
PCT Pub. Date: Jun. 13, 2019

(65) Prior Publication Data

US 2021/0368860 A1 Dec. 2, 2021

(30) Foreign Application Priority Data

Dec. 7, 2017 (EP) ..... 17205999

(51) Int. Cl.
*A24B 15/167* (2020.01)
*A24B 15/28* (2006.01)
(Continued)

(52) U.S. Cl.
CPC ..... *A24B 15/167* (2016.11); *A24B 15/283* (2013.01); *A24C 5/01* (2020.01);
(Continued)

(58) Field of Classification Search
CPC .. A24D 1/20; A24D 1/22; A24F 40/20; A24F 40/30; A24F 40/46; A24C 5/01; A24B 15/167; A24B 15/283
See application file for complete search history.

(56) References Cited

U.S. PATENT DOCUMENTS 5,499,636 A 3/1996 Baggett, Jr. et al.
5,819,751 A 10/1998 Barnes et al.
(Continued)

FOREIGN PATENT DOCUMENTS

CN 1072576 A 6/1993
CN 102762118 A 10/2012
(Continued)

OTHER PUBLICATIONS

Combined Chinese Office Action and Search Report dated Feb. 7, 2022 in Chinese Patent Application No. 201880073707.1 (with English translation), 21 pages.
(Continued)

*Primary Examiner* — Galen H Hauth
*Assistant Examiner* — Yana B Krinker
(74) *Attorney, Agent, or Firm* — Oblon, McClelland, Maier & Neustadt, L.L.P.

(57) ABSTRACT

A heated aerosol-generating article including a rod of aerosol-generating substrate is provided, the rod of aerosol-generating substrate including: a first plug of homogenised tobacco material including an aerosol former; and a second plug of homogenised tobacco material including an aerosol former, where the first plug and the second plug are coaxially aligned in an abutting end-to-end relationship, the first plug being disposed downstream of the second plug, where the first plug and the second plug differ from each other in at least one of density and composition of aerosol former, such that the first plug has a lower activation temperature
(Continued)

than the second plug, and where, upon heating of the aerosol-generating substrate, the first plug releases aerosol after a shorter time than the second plug.

22 Claims, 2 Drawing Sheets

(51) Int. Cl.
*A24C 5/01* (2020.01)
*A24D 1/20* (2020.01)
*A24F 40/46* (2020.01)
*A24F 40/20* (2020.01)

(52) U.S. Cl.
CPC ..... *A24D 1/20* (2020.01); *A24F 40/46* (2020.01); *A24F 40/20* (2020.01)

(56) References Cited

U.S. PATENT DOCUMENTS

| | | | | |
|---|---|---|---|---|
| 2007/0023056 | A1 | 2/2007 | Cantrell et al. | |
| 2008/0163879 | A1 | 7/2008 | Rodrigues et al. | |
| 2012/0006343 | A1* | 1/2012 | Renaud | A24B 15/165 131/194 |
| 2012/0298123 | A1* | 11/2012 | Woodcock | A24B 15/186 131/328 |
| 2014/0345634 | A1* | 11/2014 | Zuber | A24D 1/20 131/328 |
| 2015/0013698 | A1 | 1/2015 | Woodcock et al. | |
| 2015/0150302 | A1* | 6/2015 | Metrangolo | A24D 1/22 131/230 |
| 2016/0157521 | A1 | 6/2016 | Woodcock et al. | |
| 2017/0055576 | A1 | 3/2017 | Beeson et al. | |

FOREIGN PATENT DOCUMENTS

| | | | |
|---|---|---|---|
| CN | 103929989 | A | 7/2014 |
| CN | 104411191 | A | 3/2015 |
| CN | 104411192 | A | 3/2015 |
| EP | 0 822 670 | A2 | 2/1998 |
| EP | 2 760 303 | B1 | 5/2015 |
| EP | 2 814 342 | B1 | 3/2016 |
| EP | 2 713 778 | B1 | 4/2016 |
| JP | 2014-528244 | A | 10/2014 |
| JP | 2015-517817 | A | 6/2015 |
| RU | 2 609 191 | C2 | 1/2017 |
| WO | WO 2005/058078 | A2 | 6/2005 |
| WO | WO 2009/022232 | A2 | 2/2009 |
| WO | WO 2011/045609 | A1 | 4/2011 |
| WO | WO 2012/164009 | A2 | 12/2012 |
| WO | WO 2013/178766 | A1 | 12/2013 |
| WO | WO 2013/190036 | A1 | 12/2013 |

OTHER PUBLICATIONS

International Search Report and Written Opinion dated Feb. 25, 2019 in PCT/EP2018/083842 filed on Dec. 6, 2018.

Pauly et al., "US patents shed light on Eclipse and future cigarettes", Tobacco Control, 1995, vol. 4, pp. 261-265, XP055481537.

Combined Russian Office Action and Search Report dated Dec. 22, 2021 in Chinese Patent Appiication No. 2020118600 (with English translation). 13 pages.

Notice of Grounds for Rejection dated Jan. 23, 2023 in Japanese Patent Application No. 2020-528302 (with English language translation), 7 pages.

* cited by examiner

AEROSOL-GENERATING ARTICLE HAVING AEROSOL-GENERATING SUBSTRATE WITH DUAL PLUGS

The present invention relates to a heated aerosol-generating article having a rod of aerosol-generating substrate comprising dual plugs of homogenised tobacco material that differ from each other in at least one property, and to a method for the production of such a rod of aerosol-generating substrate.

Aerosol-generating articles in which an aerosol-generating substrate, such as a tobacco-containing substrate, is heated rather than combusted, are known in the art. Typically in such heated smoking articles, an aerosol is generated by the transfer of heat from a heat source to a physically separate aerosol-generating substrate or material, which may be located in contact with, within, around, or downstream of the heat source. During use of the aerosol-generating article, volatile compounds are released from the aerosol-generating substrate by heat transfer from the heat source and are entrained in air drawn through the aerosol-generating article. As the released compounds cool, they condense to form an aerosol.

A number of prior art documents disclose aerosol-generating devices for consuming or smoking heated aerosol-generating articles. Such devices include, for example, electrically heated aerosol-generating devices in which an aerosol is generated by the transfer of heat from one or more electrical heater elements of the aerosol-generating device to the aerosol-generating substrate of a heated aerosol-generating article. One advantage of such electrically heated aerosol-generating devices is that they significantly reduce sidestream smoke.

Substrates for heated aerosol-generating articles have, in the past, typically been produced using randomly oriented shreds, strands, or strips of tobacco material. It is also known to produce substrates for heated aerosol-generating articles from sheets of homogenised tobacco material. For example, international patent application WO-A-2012/164009 discloses rods for heated aerosol-generating articles formed from gathered sheets of homogenised tobacco material. The rods disclosed in WO-A-2012/164009 have a longitudinal porosity that allows air to be drawn through the rods. Effectively, folds in the gathered sheets of tobacco material define longitudinal channels through the rod.

It would be desirable to provide a novel arrangement of the aerosol-generating substrate for an aerosol-generating article which provides greater control over the properties of the aerosol-generating substrate and the puff profile of the aerosol-generating article. It would be particularly desirable to provide such an aerosol-generating substrate that gives improved, more consistent delivery of aerosol over time. It would also be desirable to provide such an aerosol-generating substrate that can be manufactured efficiently and at high speed.

According to a first aspect of the present invention there is provided a heated aerosol-generating article comprising a rod of aerosol-generating substrate, wherein the rod of aerosol-generating substrate comprises: a first plug of homogenised tobacco material; and a second plug of homogenised tobacco material. The first plug and the second plug are coaxially aligned, the first plug being provided downstream of the second plug, and the first plug and the second plug differ from each other in at least one property of the homogenised tobacco material such that upon heating of the aerosol-generating substrate, the first plug releases aerosol after a shorter time than the second plug.

According to a second aspect of the present invention there is provided an aerosol-generating system comprising: an aerosol-generating article as defined above in relation to the first aspect of the invention; and an aerosol-generating device adapted to receive the aerosol-generating article. The aerosol-generating device comprises a heater element configured to heat both the first plug and the second plug of homogenised tobacco material during use, wherein upon heating of the aerosol-generating substrate by the heater element, the first plug releases aerosol faster than the second plug of homogenised tobacco material.

According to a third aspect of the present invention there is provided a method of at least partially producing a rod of aerosol-generating substrate for an aerosol-generating article according to any preceding claim, the method comprising the steps of: providing a first plug of homogenised tobacco material; providing a second plug of homogenised tobacco material, wherein the first plug differs from the second plug in at least one property of the homogenised tobacco material such that upon heating of the aerosol-generating substrate, the first plug releases aerosol after a shorter time than the second plug; combining the first plug and the second plug such that the first plug and the second plug are coaxially aligned and such that the first plug is arranged downstream of the second plug; and wrapping the combined first plug and second plug to form a rod of aerosol-generating substrate.

According to a fourth aspect of the invention there is provided a rod for use as an aerosol-generating substrate in an aerosol-generating article, the rod comprising: a first plug of homogenised tobacco material; and a second plug of homogenised tobacco material downstream of the first plug of aerosol-generating material. The first plug and the second plug are coaxially aligned, the first plug being provided downstream of the second plug, and the first plug and the second plug differ from each other in at least one property of the homogenised tobacco material such that upon heating of the rod during use, the first plug releases aerosol after a shorter time than the second plug.

Any references below to preferred features or aspects of the rod of aerosol-generating substrate of aerosol-generating articles according to the invention should be considered to be applicable to all aspects of the present invention.

As used herein, the term "heated aerosol-generating article" refers to an aerosol-generating article for producing an aerosol comprising an aerosol-generating substrate that is intended to be heated rather than combusted in order to release volatile compounds that can form an aerosol.

As used herein, the term "aerosol-generating substrate" refers to a substrate capable of releasing upon heating volatile compounds, which can form an aerosol. The aerosol generated from aerosol-generating substrates of aerosol-generating articles described herein may be visible or invisible and may include vapours (for example, fine particles of substances, which are in a gaseous state, that are ordinarily liquid or solid at room temperature) as well as gases and liquid droplets of condensed vapours.

As used herein, the term "rod" refers to a generally cylindrical element of substantially polygonal cross-section and preferably of circular, oval or elliptical cross-section. The term "plug" is used herein to refer to a discrete, individual element of homogenised tobacco material which forms a component of the rod. The term "sheet" is used herein to refer to a laminar element having a width and length substantially greater than the thickness thereof. The term "web" is used herein to refer to a laminar material having a length that is substantially greater than the width thereof. Typically, the term "web" is used herein to refer to the continuous layer of material from which the sheets are formed.

As used herein, the term "homogenised tobacco material" encompasses any tobacco material formed by the agglomeration of particles of tobacco material. Sheets or webs of homogenised tobacco material are formed by agglomerating particulate tobacco obtained by grinding or otherwise powdering of one or both of tobacco leaf lamina and tobacco leaf stems. In addition, homogenised tobacco material may comprise a minor quantity of one or more of tobacco dust, tobacco fines, and other particulate tobacco by-products formed during the treating, handling and shipping of tobacco. The sheets of homogenised tobacco material may be produced by casting, extrusion, paper making processes or other any other suitable processes known in the art.

As used herein, the terms "upstream" and "downstream" describe the relative positions of elements, or portions of elements, of the aerosol-generating article in relation to the direction in which the aerosol is transported through the aerosol-generating article during use.

In the following, the terms "fast release" and "slow release" will be used to identify the first plug and the second plug, respectively, that form the rod of aerosol-generating substrate and to indicate how quickly aerosol is released from each plug upon heating compared with the other plug, when the plugs are heated under the same conditions within the same device.

As described above, the aerosol-generating article of the present invention incorporates a rod comprising a first plug (in the following also referred to as a "fast release plug") and a second plug (in the following also referred to as a "slow release plug") which are adapted to differ in at least one property such that upon heating, the fast release plug begins to release a measurable amount of aerosol within a shorter time than the slow release plug. The use of these two different plugs provides greater control over the properties of the rod as a whole. By arranging these two plugs in coaxial alignment with the fast release plug provided downstream of the slow release plug and by tailoring the plugs to have at least one differing property to each other, the smoking experience provided by the rod can be adjusted and controlled with more precision in order to vary the release profile of aerosol from the rod. This effect can advantageously be achieved whilst still using a single heater element to heat both plugs, such that the device for heating the aerosol-generating article does not need to be adapted.

As a result of their differing properties, the fast release plug and the slow release plug will exhibit a different aerosol release profile or puff profile, which corresponds to the amount of aerosol released from the plug during each puff, over the duration of consumption. With the arrangement of the present invention, the fast release plug will release aerosol within a shorter time after the commencement of heating of the rod than the slow release plug. This is typically because the fast release plug has a lower activation temperature than the slow release plug, wherein the activation temperature corresponds to the lowest temperature at which a measurable amount of aerosol is released from the plug. A lower activation temperature for the fast release plug therefore provides a shorter time to first puff for the consumer and the fast release plug will release a higher level of aerosol than the slow release plug during the earlier puffs in the puff profile.

On the other hand, the slow release plug will take a longer time after heating to begin to release the aerosol but will continue to release aerosol after the release of aerosol from the fast release plug has finished. The slow release plug will therefore release a higher level of aerosol than the fast release plug during the later puffs in the puff profile. In combination, the fast release plug and the slow release plug are therefore able to provide a highly consistent delivery of aerosol over time, during consumption of the aerosol-generating article.

The provision of dual plugs within the rod of aerosol-generating substrate does not affect the overall construction of the rod or the aerosol-generating article. The rod of aerosol-generating substrate comprising the dual plugs of homogenised tobacco material can therefore advantageously be incorporated into existing high speed production lines for the manufacture of heated smoking articles, without the need for significant modification of the apparatus or techniques.

Aerosol-generating articles according to the present invention are suitable for use in an aerosol-generating system comprising an electrically heated aerosol-generating device having an internal heater element for heating the aerosol-generating substrate. For example, aerosol-generating articles according to the invention find particular application in aerosol-generating systems comprising an electrically heated aerosol-generating device having an internal heater blade which is adapted to be inserted into the rod of aerosol-generating substrate. Aerosol-generating articles of this type are described in the prior art, for example, in European patent application EP-A-0 822 670. Aerosol-generating articles according to the invention may alternatively find application in aerosol-generating systems comprising an external heater element that circumscribes the rod of aerosol-generating substrate and heats it from the outside.

Preferably, the rod of aerosol-generating substrate is adapted so that both the fast release plug and the slow release plug can be heated by the same heater element of an aerosol-generating device. This advantageously enables the rod with dual plugs to be heated in existing aerosol-generating devices, without the need for modification of the heater element. It will be appreciated, however, that in alternative embodiments, the aerosol-generating device may be adapted to provide different heater elements for each of the plugs, so that it is possible to provide a different heating profile for each plug.

As used herein, the term "aerosol-generating device" refers to a device comprising a heater element that interacts with the aerosol-generating substrate of the aerosol-generating article to generate an aerosol.

Alternatively, aerosol-generating articles according to the invention may comprise a combustible carbon heat source for heating the aerosol-generating substrate during use. Aerosol-generating articles of this type are described in the prior art, for example, in International patent application WO-A-2009/022232.

In the rod of aerosol-generating substrate of aerosol-generating articles according to the present invention, the fast release plug and the slow release plug are coaxially arranged relative to each other. The fast release plug and the slow release plug are preferably arranged in an abutting end-to-end relationship. Alternatively, the fast release plug and the slow release plug may be spaced apart from each other in the longitudinal direction.

As described briefly above, the first plug or fast release plug is downstream of the second plug or slow release plug. With such an arrangement, the fast release plug is provided closer to the mouth end of the aerosol-generating article such that the aerosol has a shorter distance to travel to get to the consumer. This may help to further reduce the time taken for aerosol to be released after heating of the rod has commenced. Furthermore, it may reduce the risk of the deposit of the aerosol from the fast release plug in subsequent downstream plugs, which may have an adverse effect on the aerosol delivery in the early puffs of the puff profile. In alternative embodiments, it may be preferable to provide the fast release plug upstream of the slow release plug.

As described above, the fast release plug and the slow release plug are adapted to differ in at least one property of the homogenised tobacco material in order to provide the difference in the release profile from the plugs. The fast release plug and the slow release plug may differ in a property of the homogenised tobacco material forming the plug. Alternatively or in addition, the fast release plug and the slow release plug may differ in a property of the overall plug, which may be determined, for example, by the form or arrangement of the homogenised tobacco material within the plug.

According to a first preferred embodiment of the invention, the fast release plug and the slow release plug are adapted such that the slow release plug has a higher density than the fast release plug. This means that there a higher amount of homogenised tobacco material is provided per unit volume in the slow release plug than in the fast release plug.

Preferably, the slow release plug with the higher density is provided upstream of the fast release plug. The slow release plug may therefore be provided at the upstream end of the rod of aerosol-generating substrate. This arrangement provides the advantages of the fast release plug being nearer the mouth end of the aerosol-generating article, as described above. In addition, where the aerosol-generating article is intended for use with an aerosol-generating device comprising a heater blade for inserting into the rod, the positioning of the higher density plug at the upstream end of the rod advantageously enables a tighter fit with the heater blade. Furthermore, it reduces the risk of tobacco being pulled out of the rod by the heater blade when the aerosol-generating article is removed from the device, thereby reducing the need for cleaning of the device.

Preferably, the density of the slow release plug is at least about 10 percent higher than the density of the fast release plug, more preferably at least about 15 percent higher and more preferably at least about 20 percent higher.

Preferably, the density of the slow release plug is at least about 0.1 mg per cubic millimetre higher than the density of the fast release plug, more preferably at least about 0.15 mg per cubic millimetre higher and more preferably at least about 0.2 mg per cubic millimetre higher.

Preferably, the density of the slow release plug is between about 0.65 mg per cubic millimetre and about 0.85 mg per cubic millimetre, more preferably between about 0.7 mg per cubic millimetre and about 0.8 mg per cubic millimetre. The selection of the density of the slow release plug from within these ranges should be such that the desired difference in the density between the fast release plug and the slow release plug is retained, as defined above.

Preferably, the density of the fast release plug is between about 0.45 mg per cubic millimetre and about 0.65 mg per cubic millimetre, more preferably between about 0.5 mg per cubic millimetre and about 0.6 mg per cubic millimetre. The selection of the density of the fast release plug from within these ranges should be such that the desired difference in the density between the fast release plug and the slow release plug is retained, as defined above.

The density of each plug can be readily adjusted by the skilled person to provide the required differential between the plugs. For example, the density of the homogenised tobacco material forming the plug may be different for each plug. Alternatively or in addition, the arrangement of the homogenised tobacco material within the plug may be different for each plug such that the proportion of free space within the plug may be different for each plug.

Preferably, the slow release plug has a higher resistance to draw than the fast release plug.

According to a second preferred embodiment of the invention, the fast release plug and the slow release plug are adapted such that the homogenised tobacco material has a different aerosol former composition for each plug. As used herein, the term "aerosol former" describes any suitable known compound or mixture of compounds that, in use, facilitates formation of an aerosol and that is substantially resistant to thermal degradation at the operating temperature of the aerosol-generating article. Different aerosol formers provide a different rate of aerosol release and so the type of aerosol former or the amount of a specific aerosol former (or both) can be adjusted for each plug in order to provide the required fast release and slow release profiles.

Preferably, both the slow release plug and the fast release plug comprise glycerol as aerosol former, wherein the slow release plug has a higher amount of glycerol as aerosol former than the fast release plug. Preferably, the slow release plug has at least about 2 percent by weight more glycerol than the fast release plug, more preferably at least about 5 percent by weight more and more preferably at least about 8 percent by weight more.

Preferably, in such embodiments in which the slow release plug comprises a higher amount of glycerol, at least the fast release plug further comprises propylene glycol as aerosol former. Particularly preferably, the fast release plug has at least about 2 percent by weight more propylene glycol than the slow release plug. The slow release plug may comprise a proportion of propylene glycol in addition to glycerol, or may not contain substantially no propylene glycol.

Preferably, the slow release plug comprises more than about 15 percent by weight glycerol in combination with about 4 percent or less by weight propylene glycol and the fast release plug comprises about 15 percent or less by weight glycerol in combination with at least about 5 percent by weight propylene glycol. For each plug, the selection of the levels of glycerol and propylene glycol from within these ranges should be such that the preferred difference in the levels of glycerol and propylene glycol between the fast release plug and the slow release plug is retained, as defined above.

Preferably, the slow release plug comprises between about 17 percent and about 25 percent by weight glycerol in combination with between about 0 percent and about 4 percent by weight propylene glycol and the fast release plug comprise between about 5 percent and about 15 percent by weight glycerol in combination with between about 5 percent and about 15 percent by weight propylene glycol. More preferably, the slow release plug comprises between about 18 percent and about 22 percent by weight glycerol in combination with between about 0 percent and about 2 percent by weight propylene glycol and the fast release plug comprise between about 8 percent and about 12 percent by weight glycerol in combination with between about 8 percent and about 12 percent by weight propylene glycol. For each plug, the selection of the levels of glycerol and propylene glycol from within these ranges should be such that the preferred difference in the levels of glycerol and propylene glycol between the fast release plug and the slow release plug is retained, as defined above.

It has been found that propylene glycol as aerosol former provides a faster release of aerosol than glycerol and so the composition of the aerosol formers in each plug is adapted such that the slow release plug has a higher amount of glycerol, whilst the fast release plug has a higher amount of propylene glycol in order to control the release profiles.

Preferably, the total aerosol former content of each plug is between about 15 percent and about 25 percent by weight, more preferably between about 18 percent and about 22 percent by weight. Preferably, the slow release plug and the fast release plug have substantially the same total aerosol former content as each other, with the difference between the plugs being in the ratio of glycerol to propylene glycol in the aerosol former.

According to a third embodiment of the present invention, the fast release plug and the slow release plug are adapted such that the slow release plug has a higher density than the fast release plug, as described above in relation to the first embodiment of the invention, and such that the slow release plug and the fast release plug have a different aerosol former composition, as described above in relation to the second embodiment of the present invention.

As described above, each of the plugs of the rod of aerosol-generating substrate is formed of homogenised tobacco material. The homogenised tobacco material in each plug may take a variety of forms. Preferably, at least one of the fast release plug and the slow release plug is formed from one or more sheets of homogenised tobacco material. Particularly preferably, at least one of the fast release plug and the slow release plug is formed from one or more sheets of homogenised tobacco material that have been gathered to form the plug.

The one or more sheets of homogenised tobacco material may advantageously be crimped or similarly treated. As used herein, the term "crimped" denotes a sheet having a plurality of substantially parallel ridges or corrugations. Alternatively or in addition to being crimped, the one or more sheets of homogenised tobacco material may be embossed, debossed, perforated or otherwise deformed to provide texture on one or both sides of the sheet.

Sheets of homogenised tobacco material for use in the rod of aerosol-generating articles according to the present invention preferably comprise particulate tobacco obtained by grinding or otherwise comminuting tobacco leaf lamina. Where a plurality of sheets is provided one of the plugs, the sheets may all have substantially the same composition as each other. Alternatively, the plurality of sheets may include sheets of at least two different compositions.

Sheets of homogenised tobacco material for use in the invention may have a tobacco content of at least about 40 percent by weight on a dry weight basis, more preferably of at least about 50 percent by weight on a dry weight basis more preferably at least about 70 percent by weight on a dry weight basis and most preferably at least about 90 percent by weight on a dry weight basis.

Sheets of homogenised tobacco material for use in the invention may comprise one or more intrinsic binders, that is tobacco endogenous binders, one or more extrinsic binders, that is tobacco exogenous binders, or a combination thereof to help agglomerate the particulate tobacco. Alternatively, or in addition, sheets of homogenised tobacco material for use in the aerosol-generating substrate may comprise other additives including, but not limited to, tobacco and non-tobacco fibres, aerosol-formers, humectants, plasticisers, flavourants, fillers, aqueous and non-aqueous solvents and combinations thereof.

Suitable extrinsic binders for inclusion in sheets of homogenised tobacco material for use in the invention are known in the art and include, but are not limited to: gums such as, for example, guar gum, xanthan gum, arabic gum and locust bean gum; cellulosic binders such as, for example, hydroxypropyl cellulose, carboxymethyl cellulose, hydroxyethyl cellulose, methyl cellulose and ethyl cellulose; polysaccharides such as, for example, starches, organic acids, such as alginic acid, conjugate base salts of organic acids, such as sodium-alginate, agar and pectins; and combinations thereof.

Suitable non-tobacco fibres for inclusion in sheets of homogenised tobacco material for use in the aerosol-generating substrate are known in the art and include, but are not limited to: cellulose fibers; soft-wood fibres; hard-wood fibres; jute fibres and combinations thereof. Prior to inclusion in sheets of homogenised tobacco material for use in the aerosol-generating substrate, non-tobacco fibres may be treated by suitable processes known in the art including, but not limited to: mechanical pulping; refining; chemical pulping; bleaching; sulfate pulping; and combinations thereof.

Preferably, the sheets of homogenised tobacco material comprise an aerosol former. The sheets of homogenised tobacco material may comprise a single aerosol former. Alternatively, the sheets of homogenised tobacco material may comprise a combination of two or more aerosol formers.

Suitable aerosol-formers are known in the art and include, but are not limited to: polyhydric alcohols, such as propylene glycol, triethylene glycol, 1,3-butanediol and glycerine; esters of polyhydric alcohols, such as glycerol mono-, di- or triacetate; and aliphatic esters of mono-, di- or polycarboxylic acids, such as dimethyl dodecanedioate and dimethyl tetradecanedioate.

Preferably, the sheets of homogenised tobacco material have an aerosol former content of greater than 5 percent on a dry weight basis.

The sheets of homogenised tobacco material may have an aerosol former content of between approximately 5 percent and approximately 30 percent on a dry weight basis.

In a preferred embodiment, the sheets of homogenised tobacco material have an aerosol former content of approximately 20 percent on a dry weight basis.

In the rod of aerosol-generating substrate of aerosol-generating articles according to the second and third preferred embodiments of the invention, as described above, the aerosol former for each plug comprises glycerol or a combination or glycerol with propylene glycol, wherein the ratio of glycerol to propylene glycol is adjusted to provide the desired aerosol release profile for each plug.

Sheets of homogenised tobacco for use in the invention preferably have a width of between about 70 mm and about 250 mm, for example between about 120 mm and about 160 mm. Preferably, the thickness of the sheets of homogenised tobacco material is between about 50 micrometres and about 300 micrometres, more preferably between about 150 micrometres and about 250 micrometres.

Sheets of homogenised tobacco for use in the aerosol-generating article of the present invention may be made by methods known in the art, for example the methods disclosed in International patent application WO-A-2012/164009 A2.

In a preferred embodiment, sheets of homogenised tobacco material for use in the aerosol-generating article are formed from a slurry comprising particulate tobacco, guar gum, cellulose fibres and glycerine by a casting process.

In preferred embodiments of the invention, both the fast release plug and the second release plug are formed of one or more sheets of homogenised tobacco material, wherein the composition or arrangement of the sheets in each plug is adapted in order to provide the desired difference in the aerosol release profile, as discussed above. Alternatively, one of the plugs may be formed of one or more sheets of homogenised tobacco material, with the other plug being of a different form. For example, the other plug may be formed from an extruded tobacco material, or from a plurality of longitudinal strands of tobacco material. Alternatively again, both of the plugs may be formed of a tobacco material that is not in the form of a sheet, such as those described above.

The fast release plug and the slow release plug are preferably substantially the same length as each other, although in some embodiments they may have a different length to each other. The preferred length of each plug is between about 3 mm and about 8 mm, more preferably between about 4 mm and about 6 mm. The rod of aerosol-generating substrate comprising the dual plugs may have a length of between about 7 millimetres and about 15 mm. In one embodiment, the rod of aerosol-generating substrate may have a length of about 10 millimetres. In a preferred embodiment, the rod of aerosol-generating substrate has a length of about 12 millimetres.

The rod of aerosol-generating substrate preferably has an external diameter that is approximately equal to the external diameter of the aerosol-generating article.

Preferably, the rod of aerosol-generating substrate has an external diameter of at least 5 millimetres. The rod of aerosol-generating substrate may have an external diameter of between about 5 millimetres and about 12 millimetres, for example of between about 5 millimetres and about 10 millimetres or of between about 6 millimetres and about 8 millimetres. In a preferred embodiment, the rod of aerosol-generating substrate has an external diameter of 7.2 millimetres, to within 10 percent.

Preferably, the rod of aerosol-generating substrate has a substantially uniform cross-section along the length of the rod. Particularly preferably, the rod of aerosol-generating substrate has a substantially circular cross-section.

Preferably, the rod of aerosol-generating substrate is circumscribed by a wrapper, wherein the wrapper secures the plugs of homogenised tobacco material together. The wrapper may be formed of a porous or non-porous sheet material. The wrapper may be formed of any suitable material or combination of materials. Preferably, the wrapper is a paper wrapper. The fast release plug and the slow release plug may optionally be individually wrapped before being wrapped together as described above.

The aerosol-generating articles according to the invention preferably comprise a rod of aerosol-generating substrate that consists only of the fast release plug and the slow release plug. However, in alternative embodiments, additional plugs of homogenised tobacco material may be combined with the fast release plug and the slow release plug.

The aerosol-generating articles according to the invention preferably comprise one or more elements in addition to the rod of aerosol-generating substrate, wherein the rod and the one or more elements are assembled within a substrate wrapper. For example, aerosol-generating articles according to the invention may further comprise at least one of: a mouthpiece, an aerosol-cooling element and a support element such as a hollow acetate tube. For example, in one preferred embodiment, an aerosol-generating article comprises, in linear sequential arrangement, a rod of aerosol-generating substrate as described above, a support element located immediately downstream of the aerosol-generating substrate, an aerosol-cooling element located downstream of the support element, and an outer wrapper circumscribing the rod, the support element and the aerosol-cooling element.

The aerosol-generating system according to the second aspect of the present invention comprises an aerosol-generating article as described above in combination with an aerosol-generating device which is adapted to receive the aerosol-generating article and which comprises a heating element that is configured to heat both the fast release plug and the slow release plug of homogenised tobacco material during use.

The heater element is preferably a heater blade that is adapted to be inserted into the rod of aerosol-generating substrate so that the heater blade heats both of the plugs from the inside. Alternatively, the heater element may be an external heater that at least partially surrounds the plugs of homogenised tobacco material and heats them both from the outside. An external heater element will typically heat the plugs of homogenised tobacco material through at least one wrapper circumscribing the rod and may or may not be in contact with the surface of the rod. In some devices, an induction heater element may be provided.

The heater element may provide a uniform heating profile along the length of the heater element. Alternatively, the heater element may be configured such that different heating profiles are provided along the length, wherein the fast release plug and the slow release plug can be heated with a different heating profile. In this way, the heating profile for each plug can be separately adjusted to take into account the construction of the plug.

The rods of aerosol-generating substrate for use in aerosol-generating articles according to the invention, described in detail above, may be produced using a method according to the third aspect of the invention, as defined above. In the first steps of the method according to the invention, a fast release plug of homogenised tobacco material and a slow release plug of homogenised tobacco material are provided, wherein the fast release plug and the slow release plug differ in at least one property to provide a different aerosol release profile, as discussed above. The fast release plug and the slow release plug are combined such that the plugs are coaxially aligned and the combined plugs are wrapped to form the rod.

The wrapped rod may then be combined with the other components of the aerosol-generating article in a conventional assembly method.

Preferably, a continuous sequence of alternating fast release plugs and slow release plugs is provided, which is wrapped to form a continuous rod. The continuous rod is then severed to form a plurality of discrete rods. In some embodiments of the invention, each discrete rod comprises an arrangement of the fast release and slow release plugs for forming a pair of aerosol-generating article. In such an arrangement, the plug that is intended to be downstream is provided between a pair of the upstream plugs, wherein the downstream plug has a length that is twice the length of the downstream plug in the assembled aerosol-generating article. Once the pair of aerosol-generating articles has been assembled, the arrangement of plugs can be severed down the middle to form two separate aerosol-generating article, each comprising a rod having dual plugs.

The invention will now be further described with reference to the figures in which.

Figure 1:
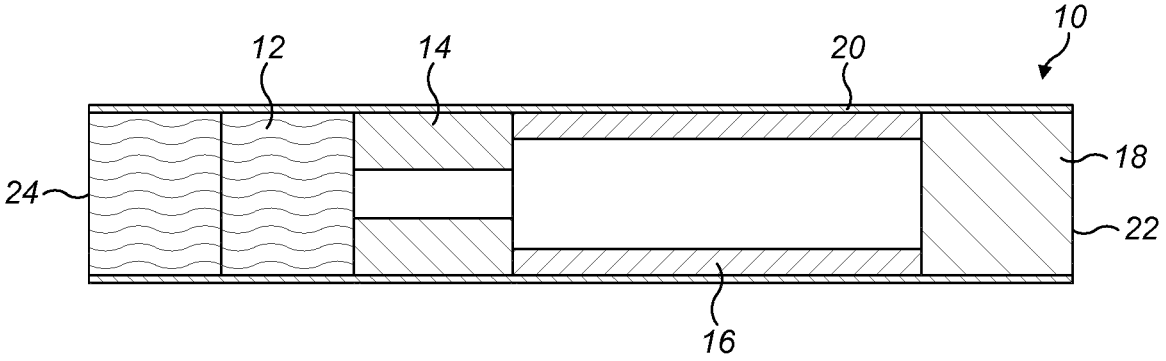
FIG. 1 shows a schematic longitudinal cross-sectional view of an aerosol-generating article according to the invention.

The aerosol-generating article 10 shown in FIG. 1 comprises a rod of aerosol-generating substrate 12, a hollow cellulose acetate tube 14, a spacer element 16 and a mouthpiece filter 18. These four elements are arranged sequentially and in coaxial alignment and are circumscribed by a substrate wrapper 20 to form the aerosol-generating article 10. The aerosol-generating article 10 has a mouth end 22 and a distal end 24 located at the opposite end of the article to the mouth end 22. The aerosol-generating article 10 shown in FIG. 1 is particularly suitable for use with an electrically operated aerosol-generating device comprising a heater for heating the rod of aerosol-generating substrate.

The rod of aerosol-generating substrate 12 has a length of approximately 12 millimetres and a diameter of approximately 7 millimetres. The rod 12 is cylindrical in shape and has a substantially circular cross-section.

Figure 2:
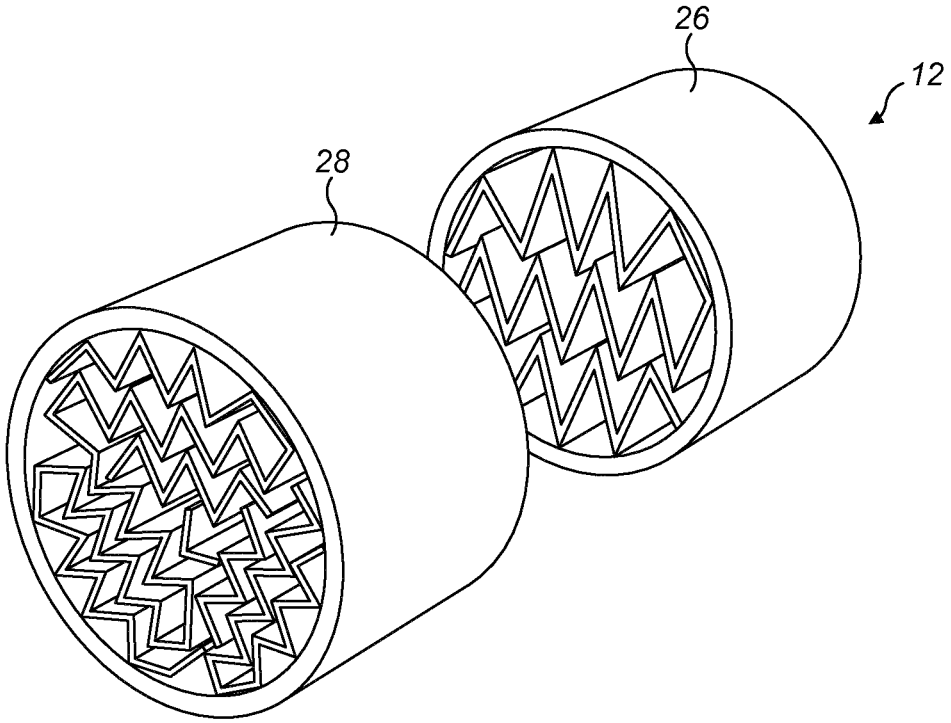
FIG. 2 shows an exploded view of a first embodiment of a rod of aerosol-generating substrate for use in the aerosol-generating article shown in FIG. 1.

A first embodiment of a rod of aerosol-generating substrate 12 for use in the aerosol-generating article 10 of FIG. 1 is shown in FIG. 2. The rod 12 comprises dual plugs of homogenised tobacco material: a fast release plug 26 provided at the downstream end of the rod 12 and a slow release plug 28 provided at the upstream end of the rod 12. The fast release plug 26 and the slow release plug 28 have a substantially equal length to each other and are provided in an abutting end-to-end relationship in the assembled aerosol-generating article 10.

Each of the fast release plug 26 and the slow release plug 28 is formed of a gathered sheet of homogenised tobacco material. The sheet of homogenised tobacco material forming the slow release plug 28 is gathered such that the slow release plug 28 has a density that is at least 30 percent higher than the density of the fast release plug 26.

Figure 3:
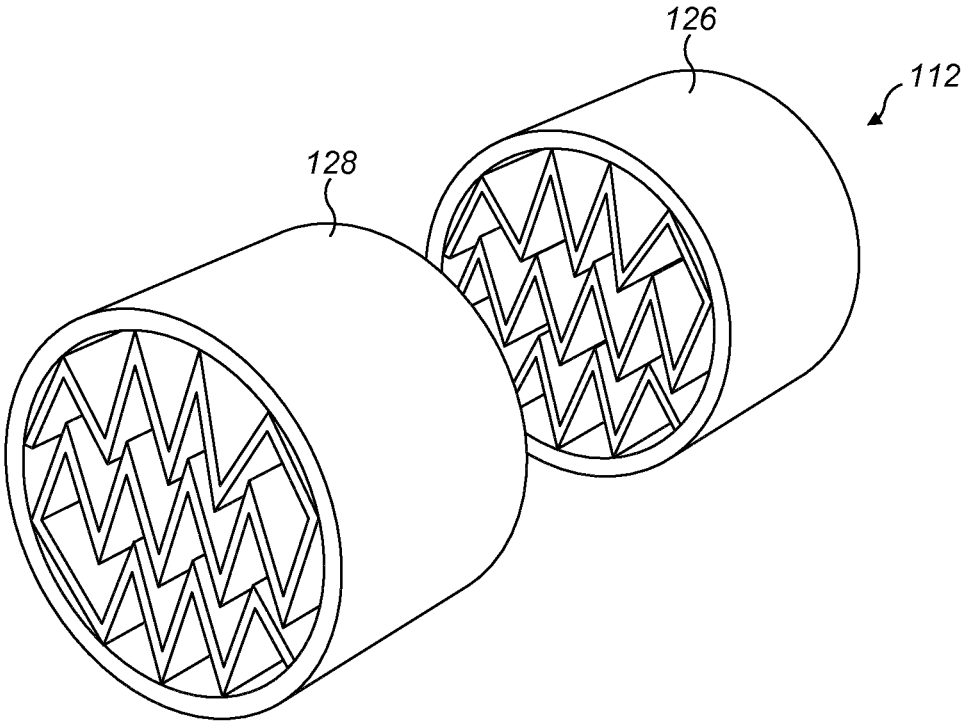
FIG. 3 shows an exploded view of a second embodiment of a rod of aerosol-generating substrate for use in the aerosol-generating article shown in FIG. 1.

A second embodiment of a rod of aerosol-generating substrate 112 for use in the aerosol-generating article 10 of FIG. 1 is shown in FIG. 3. As in the rod of aerosol-generating substrate 12 shown in FIG. 2, the rod 112 comprises a fast release plug 126 provided at the downstream end of the rod 112 and a slow release plug 128 provided at the upstream end of the rod 112. The fast release plug 126 and the slow release plug 128 have a substantially equal length to each other and are provided in an abutting end-to-end relationship in the assembled aerosol-generating article 10.

Each of the fast release plug 126 and the slow release plug 128 is formed of a gathered sheet of homogenised tobacco material and the plugs have substantially the same density as each other. However, the sheets forming the fast release plug 126 and the slow release plug 128 have a different composition to each other. In particular, the homogenised tobacco material of the fast release plug 126 has a different composition of aerosol former to the homogenised tobacco material of the slow release plug 128. The aerosol former of the homogenised tobacco material of the fast release plug 126 comprises a combination of glycerol and propylene glycol in a 1:1 ratio. The aerosol former of the homogenised tobacco material of the slow release plug 128 comprises glycerol without propylene glycol. In each of the plugs, the total aerosol former content of the homogenised tobacco material is approximately 20 percent by weight.

Figure 4:
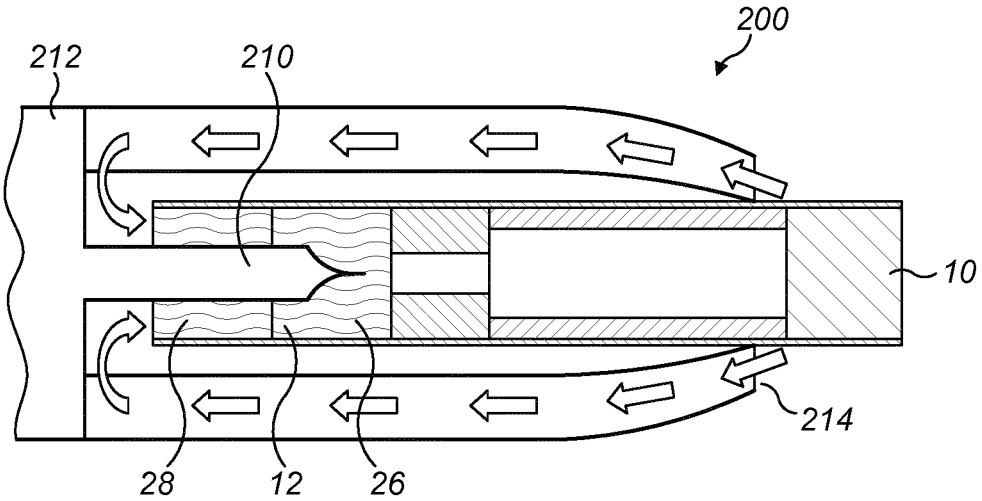
FIG. 4 shows a schematic longitudinal cross-sectional view of an aerosol-generating system comprising an electrically operated aerosol-generating device and the aerosol-generating article shown in FIG. 1 or 2.

FIG. 4 shows a portion of an electrically operated aerosol-generating system 200 that utilises a heater blade 210 to heat the rod of aerosol-generating substrate 12 of the aerosol-generating article 10 shown in FIG. 1. The heater blade 210 is mounted within an aerosol-generating article chamber within a housing of an electrically operated aerosol-generating device 212. The aerosol-generating device 212 defines a plurality of air holes 214 for allowing air to flow to the aerosol-generating article 10, as illustrated by the arrows in FIG. 4. The aerosol-generating device 212 comprises a power supply and electronics, which are not shown in FIG. 6.

The aerosol-generating article 10 shown in FIG. 1 is designed to engage with the aerosol-generating device 212 shown in FIG. 4 in order to be consumed. The user inserts the aerosol-generating article 10 into the aerosol-generating device 212 so that the heater blade 210 is inserted into the rod of aerosol-generating substrate 12, through both the fast release plug 26 and the slow release plug 28. The mouthpiece filter 18 projects outwards from the mouth end of the device 212. After the aerosol-generating article 10 is engaged with the aerosol-generating device 212, the dual plugs 26, 28 of the rod of aerosol-generating substrate 12 are both simultaneously heated by the heater blade 210 to a temperature sufficient to generate an aerosol from the rod of aerosol-generating substrate 12. The aerosol is drawn through the mouth end filter 18.

Upon heating of the rod of aerosol-generating substrate 12 during use, the fast release plug 28 begins to release aerosol within a shorter time after the commencement of heating than the slow release plug 26. The activation temperature of the fast release plug 28 is therefore lower. As the temperature increases further, the slow release plug 28 will also being to release aerosol.

It will be appreciated that an aerosol-generating article 10 incorporating the rod of aerosol-generating substrate 112 shown in FIG. 3 could be consumed in a similar way using the aerosol-generating device 212 shown in FIG. 4. As described in relation to the rod of aerosol-generating substrate 12, upon heating the rod of aerosol-generating substrate 52 during use, the fast release plug 128 begins to release aerosol within a shorter time after the commencement of heating than the slow release plug 126.

It will be appreciated that the aerosol-generating article 10 shown in FIG. 1 may also be suitable for use with other types of aerosol-generating devices.

The invention claimed is:

1. A heatable aerosol-generating article, comprising:

a rod of aerosol-generating substrate, wherein the rod of aerosol-generating substrate comprising:

a first plug comprising glycerol; and a second plug of comprising glycerol, wherein the first plug and the second plug are coaxially aligned, the first plug being provided downstream of the second plug, and wherein the second plug has a higher amount of glycerol than the first plug.

2. The heatable aerosol-generating article of claim 1, wherein the second plug has a higher density than the first plug.

3. The heatable aerosol-generating article of claim 1, wherein the density of the second plug is at least 10 percent higher than the density of the first plug.

4. The heatable aerosol-generating article of claim 1, wherein the density of the second plug is at least 15 percent higher than the density of the first plug.

5. The heatable aerosol-generating article of claim 1, wherein the density of the second plug is at least 20 percent higher than the density of the first plug.

6. The beatable aerosol-generating article of claim 1, wherein the density of the second plug is at least 0.1 mg per cubic millimeter higher than the density of the first plug.

7. The heatable aerosol-generating article of claim 1, wherein a glycerol content of the second plug is at least 2 percent by weight higher than the first plug, on a dry weight basis.

8. The heatable aerosol-generating article of claim 1, wherein a glycerol content of the second plug is at least 5 percent by weight greater than a glycerol content of the first plug, on a dry weight basis.

9. The heatable aerosol-generating article of claim 1, wherein a glycerol content of the second plug is at least 8 percent by weight higher than a glycerol content of the first plug, on a dry weight basis.

10. The heatable aerosol-generating article of claim 1, wherein the second plug has a higher resistance to draw the first plug.

11. The heatable aerosol-generating article of claim 1, wherein the first plug and the second plug have a different length to each other.

12. The heatable aerosol-generating article of claim 1, wherein the the first plug and the second plug are arranged in an abutting end-to-end relationship.

13. The heatable aerosol-generating article of claim 1, wherein the first plug and the second plug are individually wrapped.

14. An aerosol-generating system, comprising:

an aerosol-generating article of claim 1; and an aerosol-generating device configured to receive the aerosol-generating article, the aerosol-generating device comprising a heater element configured to heat both the first plug and the second plug during use.

15. The aerosol-generating system of claim 14, wherein the heater element is a heater blade configured to be inserted into the first plug and the second plug.

16. The heatable aerosol-generating article of claim 1, further comprising:

a hollow acetate tube located immediately downstream of the rod of aerosol-generating substrate.

17. The heatable aerosol-generating article of claim 1, wherein the first plug is a first plug of homogenized tobacco material.

18. The heatable aerosol-generating article of claim 1, wherein the second plug is a second plug of homogenized tobacco material.

19. The heatable aerosol-generating article of claim 1, wherein the first plug is a first plug of homogenized tobacco material, wherein the second plug is a second plug of homogenized tobacco material, and wherein the first plug and the second plug differ from each other in at least one property of the homogenized tobacco material.

20. The heatable aerosol-generating article of claim 1, wherein, upon heating of the aerosol-generating substrate, the first plug is configured to release aerosol after a shorter time than the second plug.

21. A method of at least partially producing a rod of aerosol-generating substrate for an aerosol-generating article of claim 1, the method comprising the steps of:

providing a first plug comprising glycerol;

providing a second plug comprising glycerol, the second plug having a higher amount of glycerol than the first plug;

combining the first plug and the second plug such that the first plug and the second plug are coaxially aligned and such that the first plug is arranged downstream of the second plug; and wrapping the combined first plug and second plug to form the rod of aerosol-generating substrate.

22. A rod configured for use as an aerosol-generating substrate in an aerosol-generating article, the rod comprising:

a first plug comprising glycerol; and a second plug comprising glycerol, wherein the first plug and the second plug are coaxially aligned, the first plug being provided downstream of the second plug, and wherein the second plug has a higher amount of glycerol than the first plug.

* * * * *